US006575923B1

(12) United States Patent
Burras

(10) Patent No.: US 6,575,923 B1
(45) Date of Patent: Jun. 10, 2003

(54) HEAD-MASSAGING APPARATUS

(76) Inventor: Jon B. Burras, 18411 Hatteras St., No. 149, Tarzana, CA (US) 91356

( * ) Notice: Subject to any disclaimer, the term of this patent is extended or adjusted under 35 U.S.C. 154(b) by 0 days.

(21) Appl. No.: 10/058,163

(22) Filed: Jan. 26, 2002

(51) Int. Cl.[7] ..... A61H 1/00
(52) U.S. Cl. ..... 601/70; 601/69; 601/67
(58) Field of Search ..... 601/46–48, 70, 601/67–75, 78–81, 140, 143–144, 134, 136; 606/201, 204

(56) References Cited

U.S. PATENT DOCUMENTS 5,140,978 A * 8/1992 Sirninger ..... 601/18
5,421,799 A * 6/1995 Rabin et al. ..... 601/71
5,468,218 A * 11/1995 Ward ..... 601/144
5,611,771 A * 3/1997 Taylor ..... 601/70
6,179,794 B1 * 1/2001 Burras ..... 601/79

* cited by examiner

*Primary Examiner*—Justine R. Yu
(74) *Attorney, Agent, or Firm*—Allan M. Shapiro

(57) ABSTRACT

The head-massaging apparatus comprises a headband for engaging over the head. A yoke on each end of the headband carries a vibrator assembly. Each vibrator assembly carries resilient applicator fingers which engage the side of the user's head in an arc around the ear. An exterior power supply is provided. The resilient applicator fingers vibrate the skin around the ear to activate the nerves and circulation as well as massage the muscles.

20 Claims, 1 Drawing Sheet

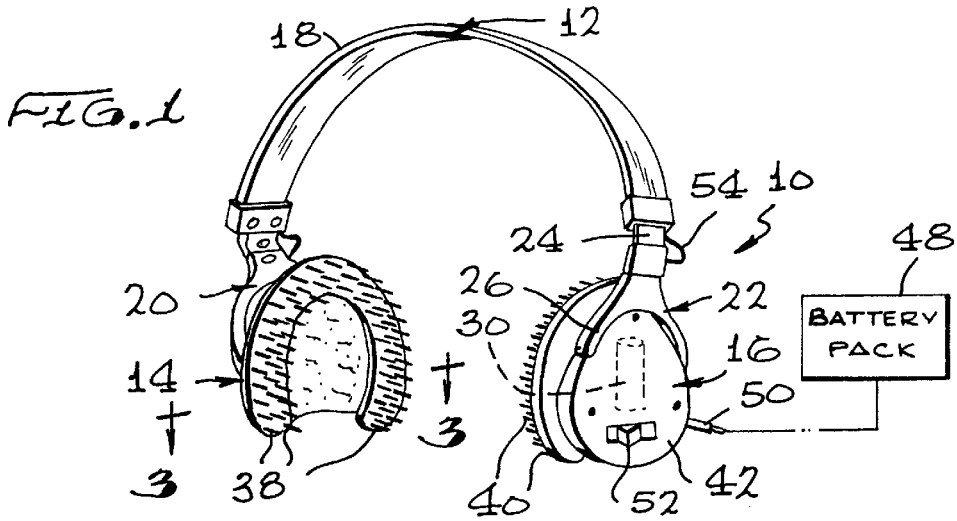
FIG. 1
12
18
54
10
24
48
BATTERY PACK
20
26
22
30
16
14
50
3
3
38
40
52
42
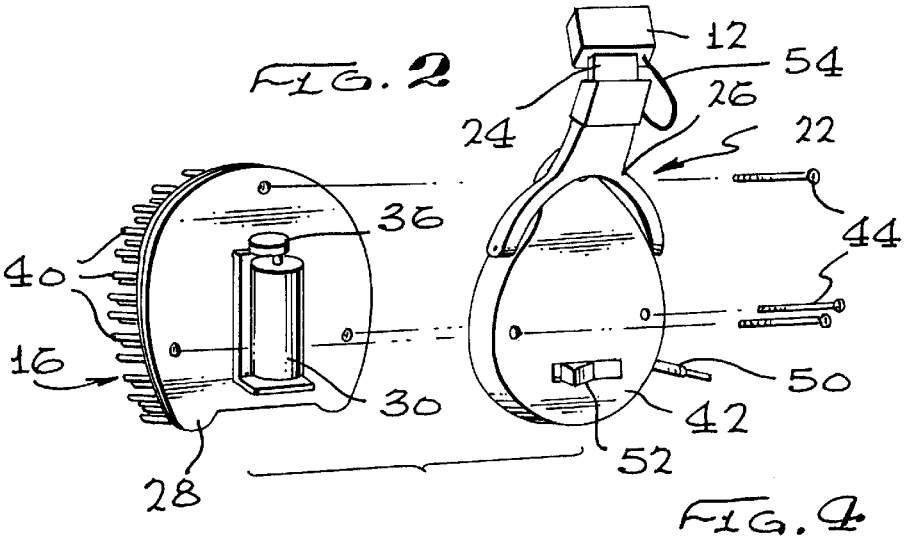
FIG. 2
12
54
26
24
22
36
44
40
16
50
30
42
52
28
FIG. 4
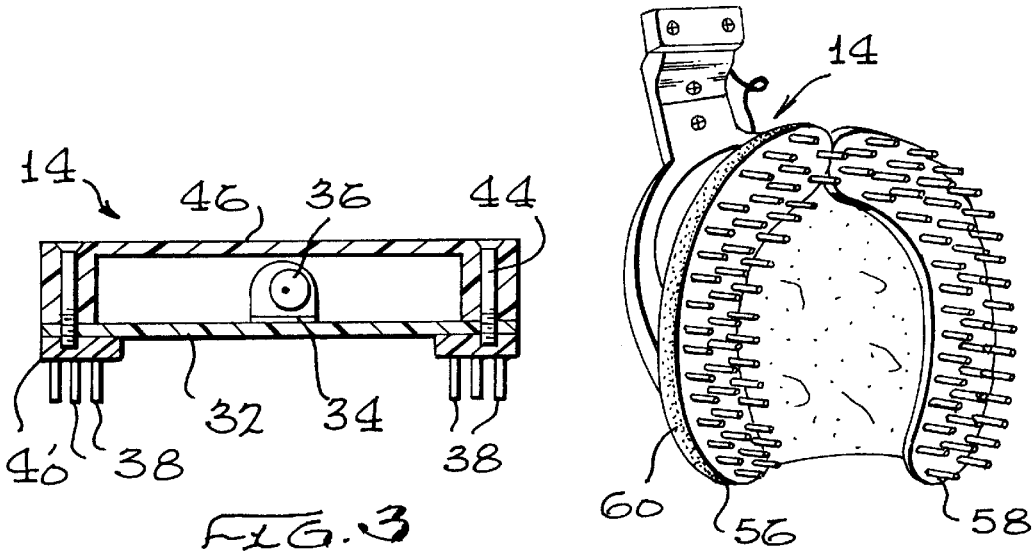
14
46
36
44
32
34
40
38
38
FIG. 3
14
60
56
58

HEAD-MASSAGING APPARATUS

FIELD OF THE INVENTION

This invention is directed to a head-massaging apparatus and particularly an apparatus which engages on the head in front of, over and behind both ears for massaging the related skin, muscles and nerves.

BACKGROUND OF THE INVENTION

Vibrators have been strapped to hands and the hands used to apply fingers to the recipient's head to convey vibrating sensation thereto. It is desirable to receive a head massage without needing another person to administer the massage. The areas around the ears are particularly affected in head massage activity.

Prior activity in the field includes Burras U.S. Pat. No. 6,179,794. The patent teaches an over-the-head band with a massaging apparatus in front of and behind each ear. This has been effective, but it is found to be desirable to also apply massage above the ears. In addition, a more direct application of the source of vibration to the massaging fingers improves the massaging result.

SUMMARY OF THE INVENTION

In order to aid in the understanding of this invention, it can be stated in essentially summary form that it is directed to a head-massaging apparatus which includes a headband which extends over the head and supports a vibrator assembly adjacent each ear. The vibrator assembly has a platform which carries the vibrator and attached to the platform are resilient applicator fingers. The fingers preferably engage in front of, in back of and over the ears.

It is thus a purpose and advantage of this invention to provide a head-massaging apparatus which has many advantages and features which result in an unobvious head-massaging apparatus.

It is another purpose and advantage of this invention to provide head-massaging apparatus that massages the head by means of vibrating resilient applicator fingers which engage in front of, behind and over the ears so that the fingers apply vibration to the entire relevant area around the ears.

It is a further purpose and advantage of this invention to provide a head-massaging apparatus which is able to be used by the person who desires the head-massaging so that another person is not necessary to aid in the employment of the massaging apparatus.

It is a further purpose and advantage of this invention to provide a head-massaging apparatus which is easy to use and inexpensive to manufacture so it can be widely utilized.

The features of this invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective view of the head-massaging apparatus of this invention.

FIG. 2 is an enlarged exploded view of one of the vibrator assemblies.

FIG. 3 is an enlarged downwardly-looking sectional view as taken generally along line 3—3 of FIG. 1.

FIG. 4 is an enlarged perspective view of another embodiment of the configuration of the resilient applicator fingers.

DESCRIPTION OF THE PREFERRED EMBODIMENTS

The head-massaging apparatus of this invention is generally indicated at 10 in FIG. 1. The head-massaging apparatus comprises a headband 12 and first and second vibrator assemblies 14 and 16. The headband 12 is a curved tubular band 18 of rectangular tubular crossection which is shaped to extend over the user's head. Yoke assemblies 20 and 22 each have a tongue which extends upwardly into the tubular curved band 18. Tongue 24 is seen in FIGS. 1 and 2 as extending up into the headband 18. A suitable adjustment mechanism is provided so that these tongues can be moved a desired distance out of the band 18 and held in place at the selected position. This adjustment is for permitting selection of the desired distance between the band 18, which extends over the head, and the yoke assemblies. Yoke 26 is attached to the end of the tongue 24.

The vibrator assemblies 14 and 16 are substantially the same. Vibrator assembly 16, seen in FIG. 2, has a platform 28 on which is mounted vibrator motor 30. Similarly, vibrator assembly 14, seen in FIG. 3, has a platform 32 which carries vibrator motor 34. The vibrator motors 30 and 34 are electrically energized rotary motors and each carries one or more eccentric weights. Eccentric weight 36, shown in FIG. 3, is mounted on the shaft of motor 34. When these motors are energized, vibration is produced. Since the motors are mounted on the platforms, the platforms vibrate. Attached to the platforms are resilient applicator fingers. A plurality of fingers 38 is seen on the vibrator assembly 14 in FIGS. 1 and 3, while a plurality of fingers 40 is seen on the vibrator assembly 16 in FIGS. 1 and 2.

As best seen in FIG. 3, the fingers are integrally molded on a finger base 40'. The fingers and finger base 40' are made of a rubber-like synthetic polymer composition material. The finger base is attached to the platform by means of a suitable adhesive. The vibrating platform conveys the vibration through the finger base to the fingers. As seen in FIG. 1, the finger base and the fingers are in a substantially circular ring which extends about 270°. The interior opening of the ring is sufficiently large to surround the user's ear.

Cover 42 engages on the platform 28, as seen in FIG. 2, and is retained thereon by means of a plurality of screws 44. The yoke 26 receives the cover 42. Pivot pins permit the cover 42 to rotate between the fingers of the yoke. Similarly, the cover 46 of vibrator assembly 14 is pivoted in yoke assembly 20. The pivot axes are substantially parallel so that the vibrator assemblies can freely rotate so that the fingers all apply pressure to the head.

Energization of the two vibrator motors, one on each platform, is achieved from an external power source. An external power source permits the delivery of more power than an onboard battery of convenient size. The power source may be an external battery pack 48, or may be a plug-in to a household circuit through a suitable voltage-reduction transformer. Power plug 50 delivers the power from the power source to the vibrator assembly 16. The vibrator assembly 16 may have an on/off switch 52 to control the energization of the vibrator motors. The output of switch 52 is directly connected to the motor 30. A flexible electric wire 54 extends from the switch 52 up through the tubular headband 12. This wire is seen at the right side of FIG. 1 where it enters the headband and is also seen at the left side of FIG. 1 where it comes out at the headband and enters the yoke 20 and extends past the pivot structure of the yoke into the cover 46 to energize vibrator motor 34. The user can thus conveniently turn the vibrator motors on and off.

The finger base carrying the resilient applicator fingers is arcuate in form, as described above and as shown in FIG. 1. The interior space is sufficiently large to surround the user's ear, so that the fingers engage the user's head in front, in back and over his ear. This engagement stimulates the skin and nerves throughout that area as well as massages the muscles in that area. Those muscles include facial muscles, jaw muscles and neck muscles. The adjustment of the vibrator assemblies on the headband permit the resilient applicator fingers to be properly positioned to achieve those results.

The finger base 40 has been described as being arcuate and extending approximately 270°. If desired, the finger base may be made in two or more pieces. FIG. 4 illustrates a vibrator assembly 14 as carrying first and second finger bases 56 and 58. These finger bases are substantially flat and are molded of rubber-like synthetic polymer composition material. The resilient applicator fingers 60 are integrally molded therewith. As seen in FIG. 4, these finger bases each occupy about 135° of arc. They are mounted together so that they cover substantially the same area as the resilient applicator fingers 38 described with respect to FIGS. 1–3.

This invention has been described in its presently contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A head massaging apparatus comprising:

first and second platforms, first and second vibrating motors, said first and second vibrating motors being respectively mounted on said first and second platforms;

first and second sets of resilient applicator fingers, said first and second sets of resilient applicator fingers being respectively attached to said first and second platforms, said first and second resilient applicator fingers each being arcuately positioned and sized to engage user's head in front, behind and over his ears;

a headband having first and second ends, said first and second vibrator platforms being mounted on said headband so that said headband positions said first and second sets of resilient applicator fingers to engage the user's head around his ears.

2. The head-massaging apparatus of claim 1 wherein said first and second sets of resilient applicator fingers are respectively integrally molded with first and second finger bases, said first and second finger bases being respectively attached to said first and second platforms.

3. The head-massaging apparatus of claim 2 wherein each of said first and second finger bases is a unitary structure.

4. The head-massaging apparatus of claim 2 wherein each of said first and second finger bases carries first and second resilient applicator fingers and is formed of at least two base parts.

5. The head-massaging apparatus of claim 2 wherein said headband is curved and has first and second yokes respectively at said first and second ends of said curved headband, said first and second vibrator assemblies being respectively pivoted in said first and second yokes.

6. The head-massaging apparatus of claim 5 wherein there is a connector for connection thereto of a remote power source and there is an electric wire extending from said connector and through said headband and connected to said first and second vibrator motors so that said vibrator motors are externally powered.

7. The head-massaging apparatus of claim 6 wherein there is a manually-accessible and manually-operative switch on said first vibrator assembly, said switch being connected between said connector and both said first and second vibrator motors for control of energization to said first and second vibrator motors.

8. The head-massaging apparatus of claim 2 wherein there are first and second covers respectively on said first and second vibrator platforms, said first and second covers being configured to respectively enclose said first and second vibrator motors.

9. The head-massaging apparatus of claim 8 wherein there are first and second yokes respectively on said first and second ends of said headband and said first and second covers are respectively pivotally mounted on said first and second yokes so that said first and second platforms can pivot with respect to each other to cause said resilient applicator fingers to engage the user's head.

10. A head-massaging apparatus comprising:

first and second platforms, first and second vibrator motors respectively on said first and second platforms, first and second sets of resilient applicator fingers respectively mounted on said first and second platforms, said first and second sets of resilient applicator fingers being arcuately arranged and sized to fit against the user's head around the front, back and top of his ears;

a headband, said headband pivotally engaging both said first and second platforms so that the pivotal axis of said first platform is substantially parallel to the pivotal axis of said second platform and said pivot axes being substantially parallel to the anterior-posterior direction of the wearer when said head-massaging apparatus is worn so that said first and second platforms can pivot with respect to each other to distribute loading of said resilient applicator fingers on the head of the user around his ears.

11. The head-massaging apparatus of claim 10 wherein said headband has first and second ends and is adjustable to adjust the distance from said headband to said platforms.

12. The head-massaging apparatus of claim 11 wherein said first and second vibrator motors are electric motors, said platforms and said vibrator motors respectively comprising first and second vibrator assemblies, a connector on said first vibrator assembly for connection thereto of an external power supply, an electric conductor connected between said connector and said first vibrator assembly and through said headband to said second vibrator assembly so that both said vibrator motors are powered from said connector.

13. The head-massaging apparatus of claim 12 wherein said first and second vibrator motors are electrically powered rotary motors, and each carries at least one eccentric weight.

14. A head-massaging apparatus comprising:

first and second vibrator assemblies, said first and second vibrator assemblies respectively having first and second vibrator platforms, first and second electrically powered vibrator motors respectively mounted on said first and second vibrator platforms;

first and second pluralities of resilient applicator fingers, said first and second sets of resilient applicator fingers each being arranged in arcuate configuration, said first and second sets of resilient applicator fingers being respectively mounted on said first and second vibrator platforms;

first and second pivotal mountings respectively on said first and second vibrator assemblies, pivot axes of said first and second pivotal mountings being substantially parallel to each other;

first and second yokes respectively mounted on said first and second pivotal mountings;

a headband, said headband being of curved configuration and having first and second ends, said first and second yokes being respectively mounted on said first and second ends of said arcuate headband, said sets of resilient applicator fingers and said headband being sized and configured so that said fingers engage around the ears of the user for vibrating massage of the user in front, behind and over his ears.

15. The head-massaging apparatus of claim 14 wherein at least one of said yokes is adjustably mounted with respect to said headband so that the distance between said vibrator assemblies circumferentially around said headband can be adjusted.

16. The head-massaging apparatus of claim 14 wherein said first vibrator assembly has an electrical connector thereon for connection of an exterior electric power supply to said first vibrator assembly and there is an electrical conductor through said headband from said first vibrator assembly to said second vibrator assembly so that said first and second vibrator motors in said first and second vibrator assemblies can be powered from said connector.

17. The head-massaging apparatus of claim 16 wherein there is an externally accessible switch on said first vibrator assembly, said switch being electrically connected to said connector and to said first and second vibrator motors so that said switch controls power to both said first and second vibrator motors.

18. The head-massaging apparatus of claim 14 wherein each of said sets of resilient applicator fingers is integrally molded on a finger base, each said finger base being attached to said platform so that said motors vibrate said platforms and said sets of resilient applicator fingers.

19. The head-massaging apparatus of claim 18 wherein said finger base is a single arcuate base extending substantially 270°.

20. The head-massaging apparatus of claim 18 wherein said finger base comprises a plurality of finger bases on each of said vibrator platforms, said finger bases lying adjacent each other in arcuate configuration.

* * * * *